US005904894A

United States Patent [19]

Mukohda

[11] Patent Number: 5,904,894

[45] Date of Patent: May 18, 1999

[54] ROTARY INERT GAS DISPERSION APPARATUS FOR MOLTEN METAL TREATMENT

[75] Inventor: Takaaki Mukohda, Tokyo, Japan

[73] Assignee: Pechiney Japon, Courbevoie, France

[21] Appl. No.: 08/893,033

[22] Filed: Jul. 15, 1997

[30] Foreign Application Priority Data

Jul. 16, 1996 [JP] Japan ..... 8-217699

[51] Int. Cl.[6] ..... C21C 5/48

[52] U.S. Cl. ..... 266/220; 266/233

[58] Field of Search ..... 266/217, 220, 266/233

[56] References Cited

U.S. PATENT DOCUMENTS 4,179,103 12/1979 Bentz et al. ..... 266/220

4,401,295 8/1983 Yoshida ..... 266/220

*Primary Examiner*—Scott Kastler

*Attorney, Agent, or Firm*—Pollock, Vande Sande & Amernick

[57] ABSTRACT

A rotating injector for use in the treatment of molten metal to remove impurities. Inert gas is flowed through a hollow rotary shaft having a lower gas port opening to a gas chamber surrounded by an outlet of porous material for creating micronized bubbles in the molten metal. A rotating mixer disperses the inert gas issuing from the outlet.

9 Claims, 6 Drawing Sheets

ROTARY INERT GAS DISPERSION APPARATUS FOR MOLTEN METAL TREATMENT

FIELD OF THE INVENTION

The present invention relates to a rotating injector for use in the treatment of molten metal, such as aluminum, in order to effect the removal of impurities such as hydrogen, oxides, and other non-metallic substances.

BACKGROUND OF THE INVENTION

Rotating injectors are widely used in industry for the purpose of floating separation of impurities in molten metal, by blowing a dispersion of an inert gas, such argon, nitrogen, chlorine, and the like into the melt.

Prior art rotating injectors normally comprise a hollow rotary shaft and a rotating mixer made of sintered carbon or ceramic material. The inert gas is flowed out of holes having a diameter greater then 1 mm, located at the downward end or on the side of the rotating mixer, which rotates at high speed.

Because of the size of the holes, in excess of 1 mm in diameter, the diameter of the inert gas flow through the holes when the rotating injector is not being rotated may exceed 5 mm.

To effect efficient removal from the molten metal, it is important that the area of contact between the inert gas and the molten metal be as large as possible, and thus the rotating injector has been rotated at a higher speed (200–800 rpm) to enable micronization and dispersion of the gas over the entire vessel.

From a macro standpoint, the micronization of the inert gas by means of higher speed rotation of the mixer is effective. However, the inert gas is thereby caused to be 'sticky', and its expansion in volume tends to lower the area of contact with the molten metal due to the agitation, during floating of the inert gas once micronized, as it is dispersed upwards to the molten metal surface.

In addition, due to the higher agitation force of the rotating injector, eddy currents or ripples are produced on the molten metal surface during the agitation, oxides are formed on contact with atmosphere, and hydrogen is absorbed into the molten metal. All of these phenomena have long been regarded as serious problems.

SUMMARY OF THE INVENTION

The present invention is intended to overcome the problems posed by conventional apparatus and processes, by use of a porous material providing micronization and homogeneity through a preheating effect at the outlet for the inert gas, instead of conventional high speed rotation of the rotating injector. A rotating mixer which is less than 25 mm thick is used to reduce the agitation force of the molten metal, and this prevents eddy currents and rippling over the molten metal surface.

BRIEF DESCRIPTION OF THE DRAWINGS

In order that the invention may be more clearly understood, it will now be described with reference to the accompanying drawings, wherein several embodiments of the invention are shown for purposes of illustration.

DESCRIPTION OF PREFERRED EMBODIMENTS

Figure 1:
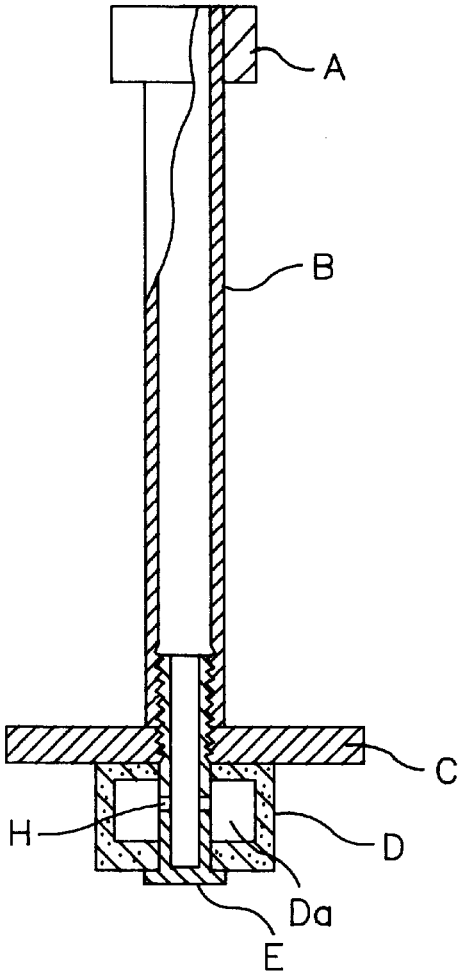
FIG. 1 is a front elevation of the rotary injector installation according to a first embodiment of the invention.

As shown in FIG. 1, a rotating mixer C less than 25 mm in height is attached to a hollow rotary shaft B connected to a sleeve A. Beneath rotating mixer C, an outlet section D for the inert gas made of porous (actually, multi-porous) material is provided for inert gas, which passes via apertures H through a gas chamber Da. Both the rotating mixer C and the inert gas outlet section D are attached to hollow shaft B by a screw E comprising these apertures.

Figure 2:
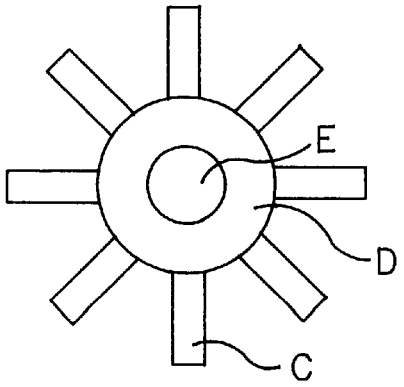
FIG. 2 is a bottom view of the same.
Figure 3:
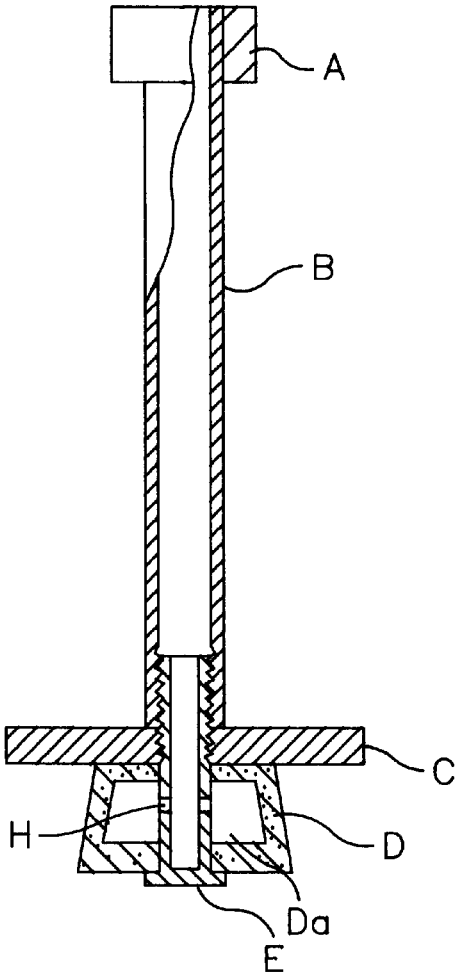
FIG. 3 is a front elevation of the rotary injector installation according to a second embodiment of the invention.
Figure 4:
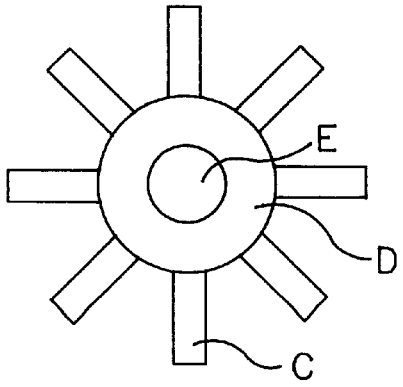
FIG. 4 is a bottom view of the same.

FIG. 3 shows a second embodiment of the rotating injector, in which the gas outlet section D has a downwardly divergent configuration which tends to prevent sticking of the outflowing inert gas. It will be noted that the top plan view of rotating mixer C is identical with that in FIG. 2, which is a top plan view of the rotating mixer in the first embodiment of FIG. 1.

Figure 5:
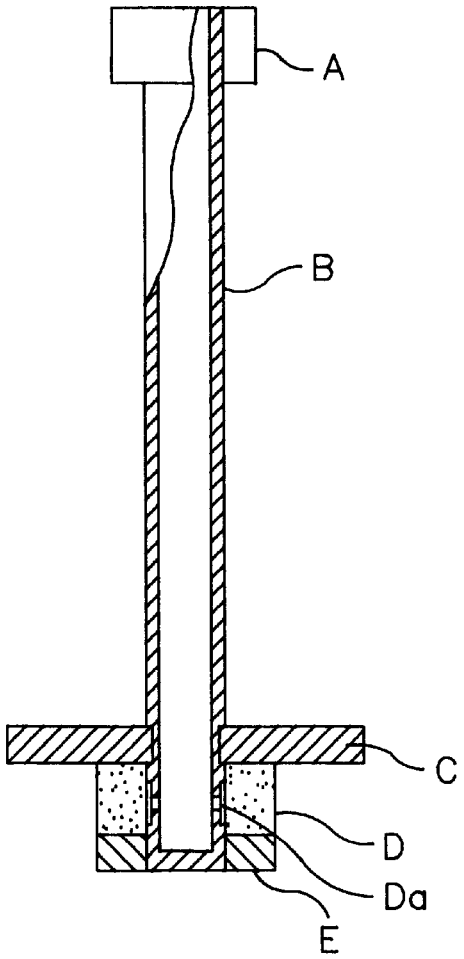
FIG. 5 is a front elevation of the rotary injector installation according to a third embodiment of the invention.
Figure 6:
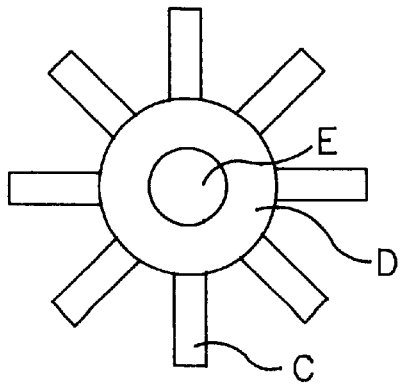
FIG. 6 is a bottom view of the same.

FIG. 5 shows a third embodiment of the rotating injector, which includes protection for inert gas outlet section D using porous (actually multi-porous) material. In this embodiment, gas chamber Da is installed, and the outer diameter of screw E is identical with that of gas outlet D.

Figure 7:
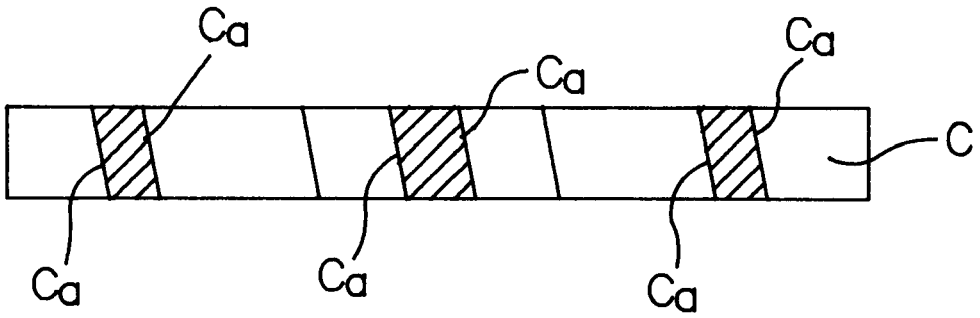
FIG. 7 is a schematic front view of the rotating mixer showing a tapered or reverse 'R' configuration.
Figure 8:
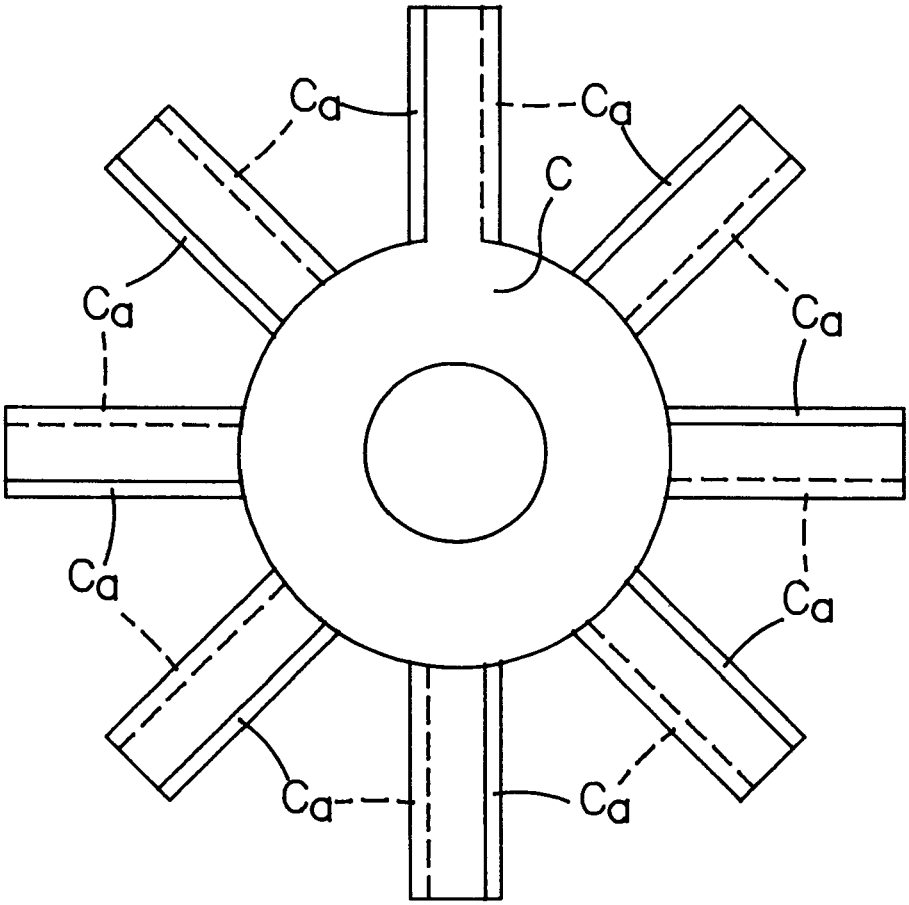
FIG. 8 is a bottom view of the same.

FIGS. 7 and 8 are front and plan views of the rotary mixer C showing the taper Ca of its blades.

Figure 9:
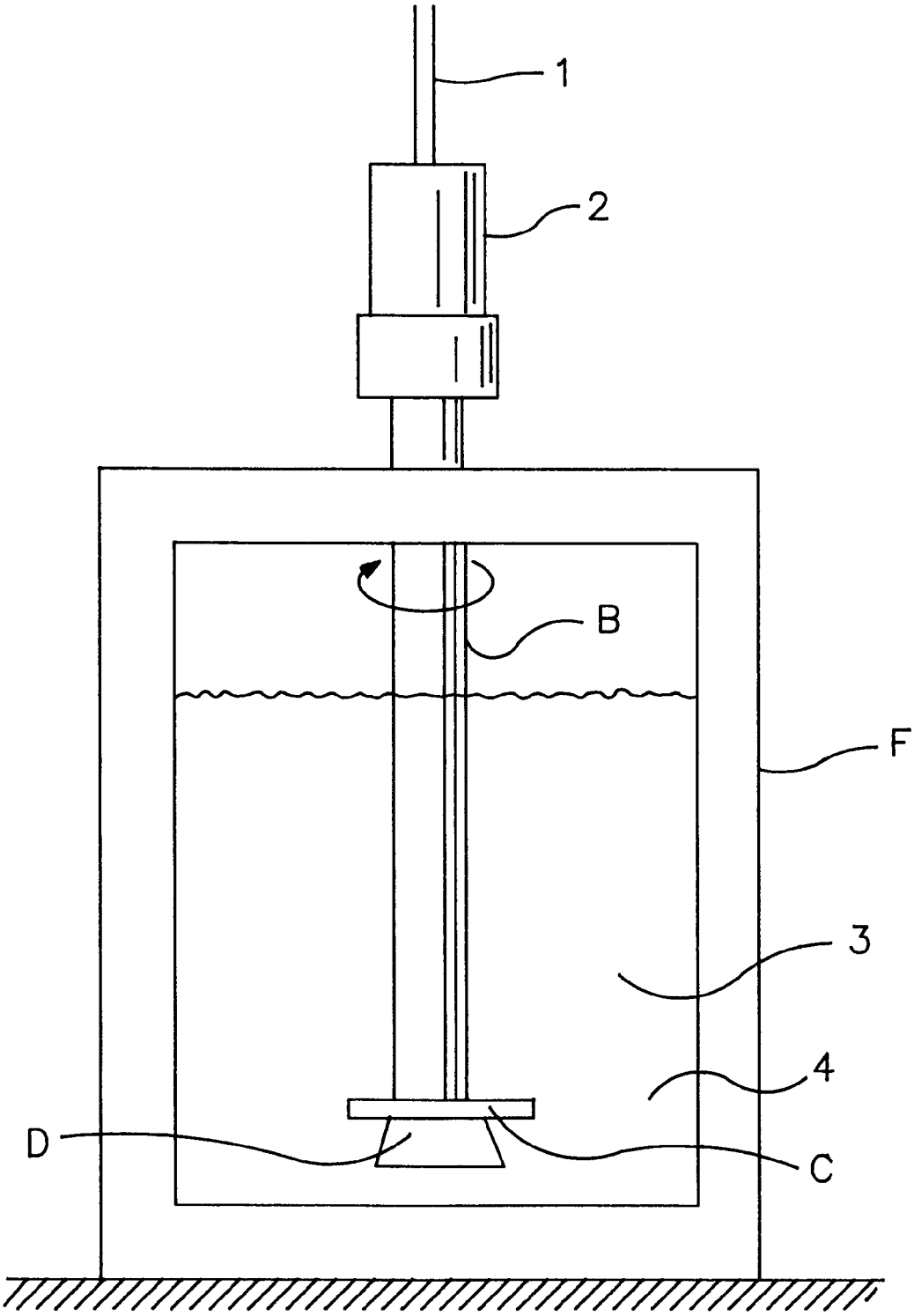
FIG. 9 shows the rotary injector in position in a water vessel during generation of an inert gas.

FIG. 9 is a front elevation view of the inventive apparatus in position in vessel F. As the rotary injector is rotated, inert gas, which is supplied through conduit 1, emerges from outlet D into metal bath 4. A drive motor 2 is provided to cause rotation of rotary shaft B.

Figure 10:
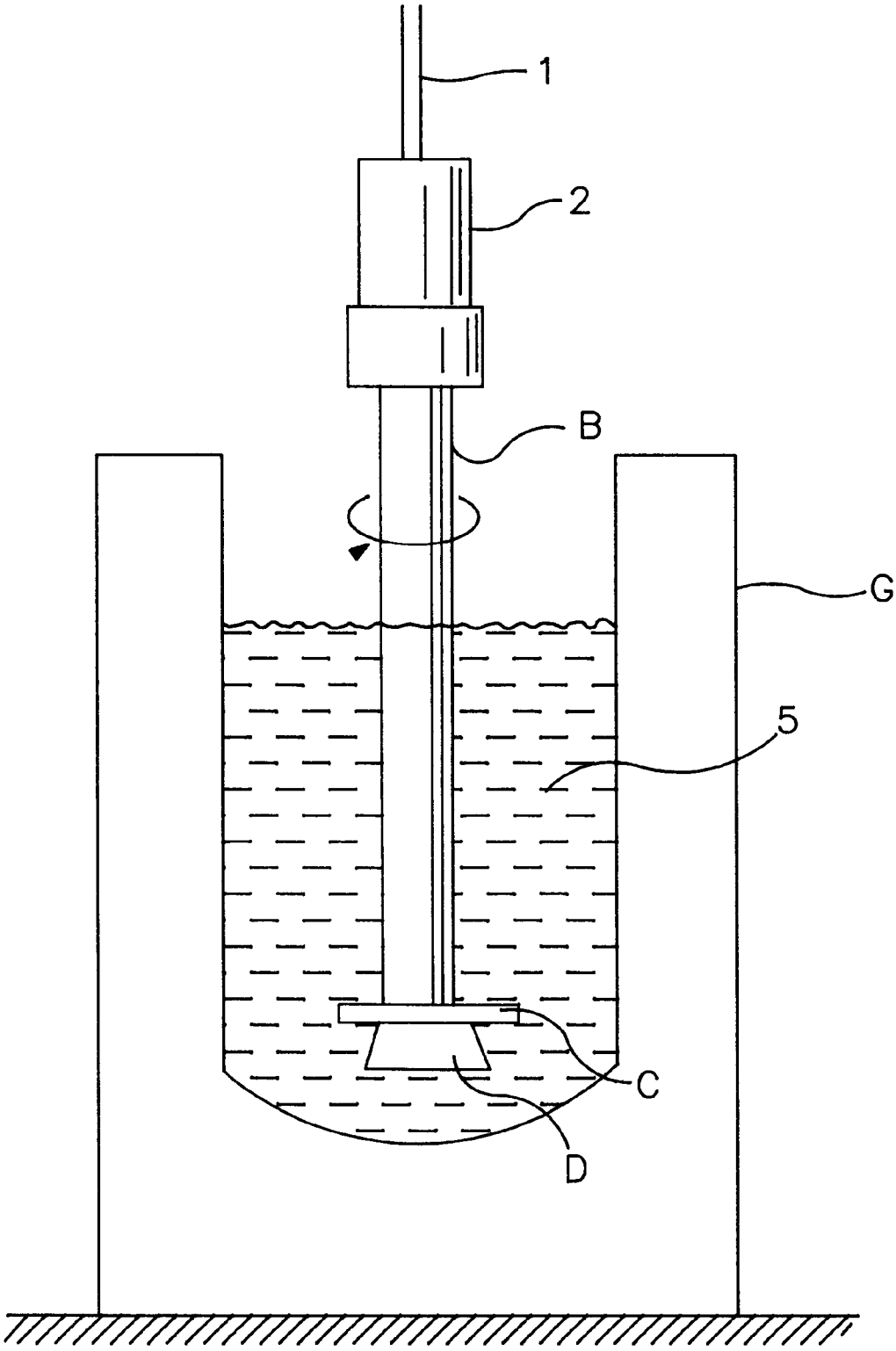
FIG. 10 shows the rotary injector positioned in molten metal in a crucible furnace, the inert gas being generated while the rotary injector is rotated.

FIG. 10 is a front elevation view of the same apparatus used in molten metal treatment. Here the rotary injector is positioned in a crucible furnace G having a curved bottom and containing molten metal 5.

Due to the provision of a gas chamber at the outlet for the inert gas, the use of porous or multi-porous material for the outlet section, a thin rotational shaft and a reduced agitation rotary mixer, the present invention achieves the generation of micronized and uniformly distributed inert gas, and prevents eddy currents and rippling at the molten metal surface. As a result, a 30% reduction in the use of inert gas was achieved in the treatment of molten A356 aluminum, as compared with conventional techniques. Moreover, the dross generated during the treatment was extremely dry and contained virtually no oxide, thus making it possible to prevent oxide formation upon contact with atmosphere.

A table showing comparative test results between the rotary injectors of the present invention and conventional injectors follows.

1. Results of Test in Al Molten Solution

| Kind of Rotary Injector | Rotary Injector of Invention 1 | Rotary Injector of this Invention 2 | Rotary Injector Conventional |
|---|---|---|---|
| Condition for Rotary RPM | 250 | 250 | 500 |
| Condition for Inert Gas Volume 1/min | 20 | 20 | 20 |
| Result on Inert Gas Bubble Size | 1–2 mm ϕ | 1 mm ϕ | 1–5 mm ϕ |
| Results: Inert Gas Dispersion in Vessel | There is no change in the gas size as it uniformly disperses | " | The dispersion is not uniform and I the gas size varies |
| Eddy Current & Rippling on the Water Surface | Eddy current-none Rippling-none | " | Eddy current - 30–40 mm Rippling - 10–15 mm |

2. Results of Test in Al Molten Metal

| | | | |
|---|---|---|---|
| Condition for Ar Gas 1/min | 15 | 15 | 15 |
| Condition for Rotary RPM | 250 | 250 | 500 |
| Time for the Treatment (min) | 7 | 7 | 7 |
| Results: | | | |
| H2 Gas Volume prior to treatment cc/100 g ALU | 0.35 | 0.35 | 0.35 |
| H2 Gas Volume after treatment cc/100 g ALU | 0.09 | 0.08 | 0.14 |

What is claimed is:

1. In an apparatus for treatment of molten metal, a rotary inert gas dispersion apparatus comprising a hollow rotary shaft (B) for flowing inert gas, said shaft having a lower end with a gas port opening (H) having a first surface area, a gas chamber (Da) downstream of said gas port and receiving a flow of inert gas issuing from said gas port (H), an outlet of porous material (D) surrounding said gas chamber for creating micronized bubbles in said molten metal, and a rotating mixer (C) for dispersion of inert gas issuing from said outlet (D), said gas chamber being located between said gas port and said outlet of porous material and being surrounded by a porous material having a second surface area greater than said first surface area, through which surface the gas volume issuing from said gas port circulates before bubbling in said molten metal.

2. The gas dispersion apparatus according to claim 1, wherein said outlet of porous material has a downwardly divergent profile.

3. The gas dispersion apparatus according to claim 1, wherein said rotating mixer has a thickness of less than 25 mm, whereby agitation of said molten metal is reduced and inert gas is uniformly dispersed.

4. The gas dispersion apparatus according to claim 1, wherein said rotating mixer comprises multiple arms.

5. The gas dispersion apparatus according to claim 4, wherein said arms comprise a taper.

6. The gas dispersion apparatus according to claim 1, wherein said gas chamber is mounted to the said hollow shaft by means of a screw comprising aperture means for the passage of said inert gas.

7. The gas dispersion apparatus according to claim 1, wherein said shaft has an outer diameter of 25 to 50 mm.

8. An apparatus for treatment of molten metal, comprising:

(a) a vessel;

(b) means for introducing an inert gas into said vessel;

(c) a rotating mixer according to claim 1, being immersed in said vessel and being rotated during introduction of said inert gas.

9. The apparatus according to claim 8, wherein said vessel has a curved bottom.

* * * * *

UNITED STATES PATENT AND TRADEMARK OFFICE

CERTIFICATE OF CORRECTION

PATENT NO. : 5,904,894

DATED : May 18, 1999

INVENTOR(S) : Takaaki Mukhoda

It is certified that error appears in the above-identified patent and that said Letters Patent is hereby corrected as shown below:

ON THE TITFLE PAGE:

Item [73] Please add the name of the second Assignee, --Pechiney Rhenalu, Courbevoie, France--

Signed and Sealed this

Eighth Day of August, 2000

*Attest:*

*Attesting Officer*

Q. TODD DICKINSON

*Director of Patents and Trademarks*